US007122771B2

(12) United States Patent
Kang

(10) Patent No.: US 7,122,771 B2
(45) Date of Patent: Oct. 17, 2006

(54) WALL MOUNTED-TYPE MICROWAVE OVEN

(75) Inventor: Jeon-Hong Kang, Gyeonggi-Do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/846,528

(22) Filed: May 17, 2004

(65) Prior Publication Data

US 2005/0092740 A1 May 5, 2005

(30) Foreign Application Priority Data

Nov. 4, 2003 (KR) ..... 10-2003-0077701

(51) Int. Cl.
*H05B 6/68* (2006.01)

(52) U.S. Cl. ..... 219/686; 219/757

(58) Field of Classification Search ..... 219/686, 219/757, 702, 718, 710, 716, 758, 681, 756, 219/691, 695, 746, 748; 126/273 A, 21 A, 126/299 D, 299 R, 275 E See application file for complete search history.

(56) References Cited

U.S. PATENT DOCUMENTS 4,886,046 A * 12/1989 Welch ..... 219/757
6,072,169 A * 6/2000 Kang et al. ..... 219/702
6,211,504 B1 * 4/2001 Lee ..... 219/757

FOREIGN PATENT DOCUMENTS

KR 2002-57147 7/2002

* cited by examiner

*Primary Examiner*—Quang Van
(74) *Attorney, Agent, or Firm*—Staas & Halsey LLP

(57) ABSTRACT

A wall mounted-type microwave oven provided with a hood having an inlet port with an improved structure, thus effectively drawing exhaust gases and food odors produced from a plurality of gas burners placed below the hood. The wall mounted-type microwave oven includes a cabinet and a hood. The cabinet has, at predetermined portions thereof, an exhaust passage and an exhaust fan. The hood is mounted to a bottom portion of the cabinet, and has an inlet port to communicate with the exhaust passage. The inlet port is formed so that a width of an end of the inlet port near to the exhaust passage is less than a width of an end of the inlet port farther from the exhaust passage. Thus, the inlet port is formed so that an area of a portion of the inlet port on which a weaker suction force of the exhaust fan acts is larger than an area of a portion of the inlet port on which a stronger suction force of the exhaust fan acts.

18 Claims, 5 Drawing Sheets

WALL MOUNTED-TYPE MICROWAVE OVEN

CROSS-REFERENCE TO RELATED APPLICATIONS

This application claims the benefit of Korean Patent Application No. 2003-77701, filed Nov. 4, 2003 in the Korean Intellectual Property Office, the disclosure of which is incorporated herein by reference.

BACKGROUND OF THE INVENTION

1. Field of the Invention

The present invention relates to wall mounted-type microwave ovens, and more particularly, to a wall mounted-type microwave oven provided with a hood having an inlet port with an improved structure, thus effectively drawing exhaust gases and food odors produced from a plurality of gas burners placed below the hood.

2. Description of the Related Art

Generally, a wall mounted-type microwave oven is mounted to a wall of a kitchen above a plurality of gas burners. The wall mounted-type microwave oven collaterally serves to exhaust gases, fumes, and food odors produced from the gas burners, which are positioned under the microwave oven, in addition to cooking food using high-frequency electromagnetic waves.

Similar to a general type microwave oven, the wall mounted-type microwave oven includes a cabinet to define an external appearance thereof. The cabinet is partitioned into a cooking cavity and a machine room, and the food to be cooked is disposed in the cooking cavity. An exhaust passage is defined between an outside of the cooking cavity and the cabinet. Further, an exhaust fan is provided to an upper portion of the exhaust passage to draw exhaust gases and food odors produced from the plurality of gas burners into the exhaust passage, and to discharge the exhaust gases and the food odors to the outside of the wall mounted-type microwave oven.

Further, a hood having an inlet port is mounted to a bottom portion of the cabinet. The inlet port of the hood communicates with the exhaust passage so that the exhaust gases and the food odors produced from the plurality of gas burners flow through the inlet port into the exhaust passage.

However, according to the conventional wall mounted-type microwave oven, the exhaust passage is provided at a side of the cabinet and the inlet port through which exhaust gases and food odors are drawn into the exhaust passage is constructed to have a constant width. Thus, a stronger suction force of the exhaust fan acts on the gas burners placed near the exhaust passage in comparison to gas burners placed far from the exhaust passage. Therefore, exhaust gases produced from gas burners placed near the exhaust passage are smoothly drawn into the exhaust passage, whereas exhaust gases produced from gas burners placed far from the exhaust passage are not smoothly drawn into the exhaust passage.

Therefore, the conventional wall mounted-type microwave oven presents a problem because the wall mounted-type microwave oven does not effectively draw and discharge exhaust gases produced from all gas burners placed below the hood.

SUMMARY OF THE INVENTION

Accordingly, it is an aspect of the present invention to provide a wall mounted-type microwave oven provided with a hood having an inlet port with an improved structure, thus effectively drawing exhaust gases and food odors produced from a plurality of gas burners placed below the hood.

The above and/or other aspects are achieved by a wall mounted-type microwave oven including a cabinet having an exhaust passage, and a hood mounted to a bottom portion of the cabinet and having at least one inlet port to communicate with the exhaust passage, the inlet port being formed so that a width of an end portion of the inlet port near the exhaust passage is less than a width of an end portion of the inlet port far from the exhaust passage.

Additional aspects and advantages of the invention will be set forth in part in the description which follows and, in part, will be obvious from the description, or may be learned by practice of the invention.

According to an aspect of the invention, the inlet port may be shaped so that a width thereof is decreased at a predetermined ratio in a direction towards the exhaust passage.

Further, according to another aspect of the present invention, the inlet port may comprise a plurality of inlet ports, which are horizontally arranged on the hood.

The inlet port may have a trapezoidal shape according to an aspect of the present invention.

Further, the above and/or other aspects are achieved by a wall mounted-type microwave oven including a cabinet having an exhaust passage, an exhaust fan provided at a predetermined location in relation to the exhaust passage, and a hood mounted to a bottom portion of the cabinet with an inlet port horizontally provided to a predetermined portion of the hood to communicate with the exhaust passage, where the inlet port is formed so that an area of a portion of the inlet port on which a weaker suction force of the exhaust fan acts is larger than an area of a portion of the inlet port on which a stronger suction force of the exhaust fan acts.

BRIEF DESCRIPTION OF THE DRAWINGS

These and/or other aspects and advantages of the invention will become apparent, and more readily appreciated from the following description of the preferred embodiments, taken in conjunction with the accompanying drawings of which.

DETAILED DESCRIPTION OF THE PREFERRED EMBODIMENTS

Figure 1:
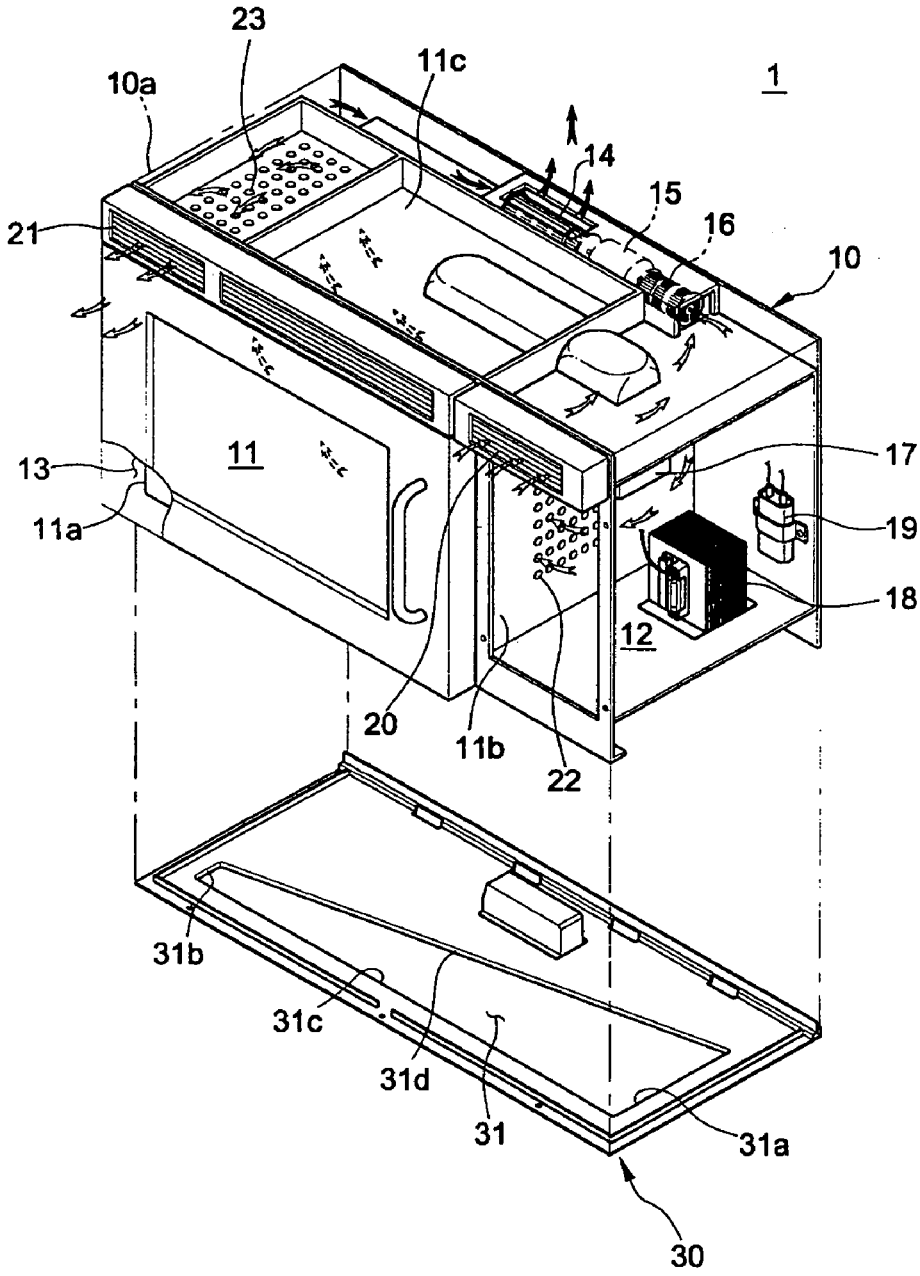
FIG. 1 is an exploded front perspective view of a wall mounted-type microwave oven having a hood according to a first embodiment of the present invention.

Reference will now be made in detail to the embodiments of the present invention, examples of which are illustrated in the accompanying drawings, wherein like reference numerals refer to like elements throughout.

Figure 2:
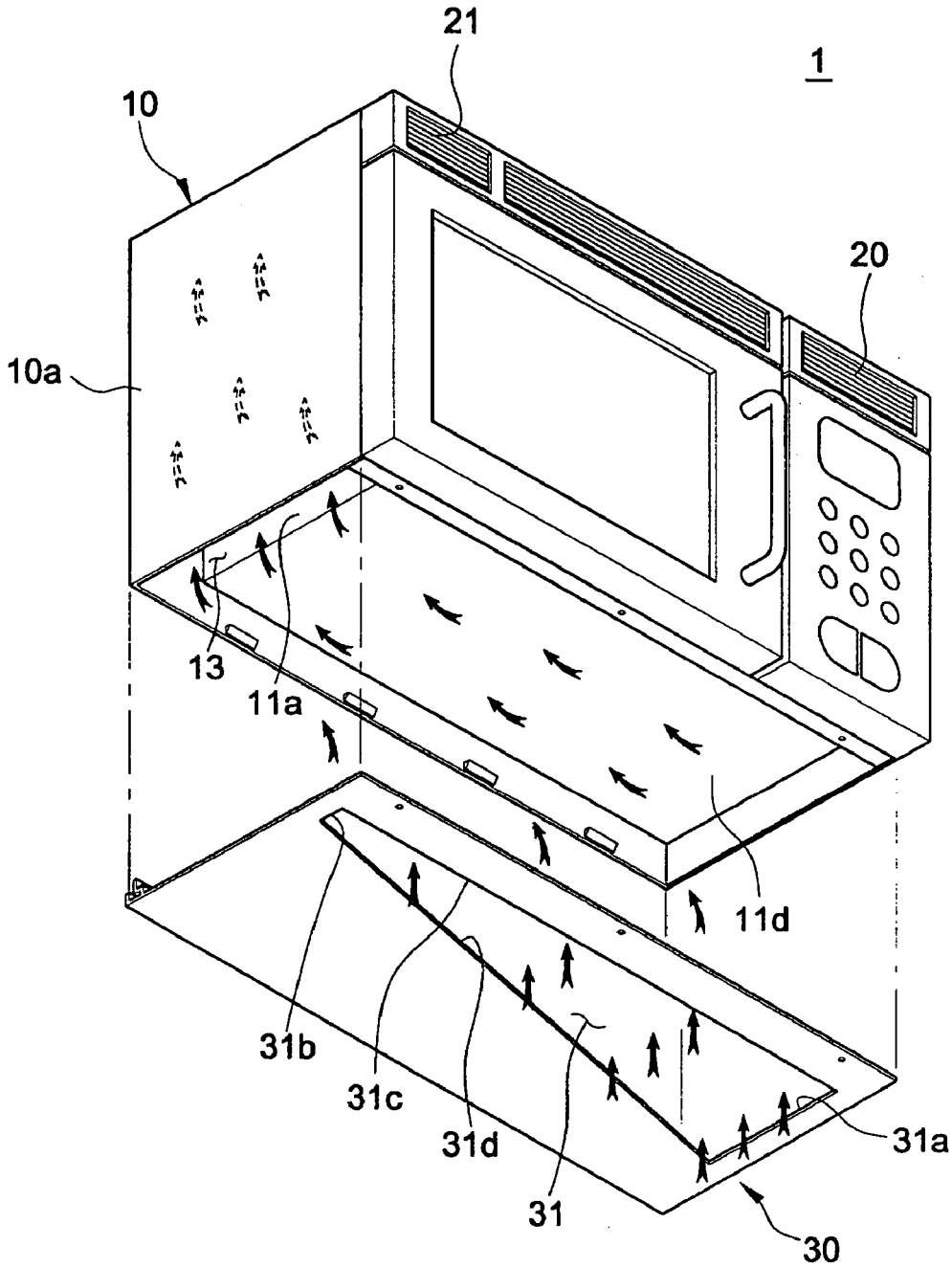
FIG. 2 is an exploded bottom perspective view of the wall mounted-type microwave oven of FIG. 1 to show a flow of exhaust gases passing through the hood.

FIGS. 1 and 2 respectively show an exploded front perspective view and an exploded bottom perspective view of a wall mounted-type microwave oven having a hood according to a first embodiment of the present invention.

As shown in FIGS. 1 and 2, the wall mounted-type microwave oven 1 includes a cabinet 10, which is box-shaped, and defines an external appearance of the wall mounted-typed microwave oven 1. The cabinet 10 is partitioned into a cooking cavity 11 and a machine room 12.

An exhaust passage 13 is provided between a left side plate 10*a* of the cabinet 10 and a left side plate 11 a of the cooking cavity 11. The exhaust passage 13 guides exhaust gases and fumes produced from a cooking apparatus 50 (shown in FIG. 5) located below the cabinet 10 that includes gas burners 51 and 52to discharge the exhaust gases and the fumes to an outside of the wall mounted-type microwave oven. Further, an exhaust fan 14 and a fan motor 15 are installed to an upper rear portion of the cabinet 10 to discharge the exhaust gases and the fumes, which flow along the exhaust passage 13, to the outside of the wall mounted-type microwave oven.

The exhaust fan 14 is mounted to a left side of the fan motor 15, and is operated by the fan motor 15. Further, a cooling fan 16 is mounted to a right side of the fan motor 15 to supply air to the machine room 12, thus cooling electrical devices including a magnetron 17, a high-voltage transformer 18, and a condenser 19 which are installed in the machine room 12.

A front suction grill 20 is provided to an upper front portion of the machine room 12, and a front discharging grill 21 is provided to an upper front portion of the cooking cavity 11. A plurality of perforations 22 are provided to a right side plate 11*b* of the cooking cavity 11, which partitions the cooking cavity 11 and the machine room 12 from each other. Further, a plurality of perforations 23 are provided to a top plate 11*c* of the cooking cavity 11.

Accordingly, due to the cooling fan 16 air flows into the machine room 12 through the front suction grill 20, thus cooling the electrical devices. Subsequently, the air passes through the perforations 22 and 23 and the front discharging grill 21, thus discharging steam and food odors produced in the cooking cavity 11 during a cooking process to an outside of the cooking cavity 11.

According to an aspect of the invention, a hood 30 having an inlet port 31 is mounted to a bottom portion of the cabinet 10. The exhaust gases produced from the gas burners 51 and 52 (shown in FIG. 5), which are placed below the cabinet 10, enter the inlet port 31 of the hood 30 and flow along the exhaust passage 13. The hood 30 is mounted to the bottom portion of the cabinet 10 spaced from a bottom plate 11*d* (shown in FIG. 2) of the cooking cavity 11 by a predetermined distance, thus allowing air passing through the inlet port 31 of the hood 30 to flow into the exhaust passage 13.

The inlet port 31 is horizontally formed spaced from left and right edges of the hood 30 by predetermined distances. According to an aspect of the present invention, a right edge 31*a* of the inlet port 31 is the longest, while a left edge 31*b* of the inlet port 31 is the shortest.

As such, the right edge 31*a* of the inlet port 31 is formed to be longer than the left edge 31*b* of the inlet port 31 because a stronger suction force of the exhaust fan 14 acts on a portion around the left edge 31*b* of the inlet port 31 that is near the exhaust passage 13 in comparison to a portion around the right edge 31*a* of the inlet port 31, which is far from the exhaust passage 13. Meaning, because the stronger suction force of the exhaust fan 14 acts on the portion around the left edge 31*b* of the inlet port 31, a larger amount of exhaust gas is drawn to the portion around the left edge 31*b* of the inlet port 31 in comparison to the portion around the right edge 31*a* of the inlet port 31. This causes exhaust gases produced from the gas burners 51, which are placed below the left edge 31*b* of the inlet port 31, to be smoothly drawn to the inlet port 31 and flow along the exhaust passage 13. However, exhaust gases produced from the gas burners 52, which are placed below the right edge 31*a* of the inlet port 31, are not smoothly drawn to the inlet port 31.

Thus, the inlet port 31 is constructed so that the right edge 31*a* far from the exhaust passage 13 is the longest, and the left edge 31*b* near the exhaust passage 13 is the shortest. Thereby, the length from a front edge 31*c* to a rear edge 31*d* of the inlet port 31, that is, a width of the inlet port 31, is gradually and evenly decreased in a direction from the right edge 31*a* to the left edge 31*b* of the inlet port 31. According to an aspect of the present invention, the wall mounted-type microwave oven 1 has one trapezoid inlet port 31.

In the inlet port 31 according to an aspect of the invention, an area of the portion around the left edge 31*b* of the inlet port 31 towards which the stronger suction force of the exhaust fan 14 acts, is smaller, while an area of the portion around the right edge 31*a* of the inlet port 31 on which the weaker suction force of the exhaust fan 14 acts is larger.

Thus, when the exhaust fan 14 is operated, the exhaust gases produced from the gas burners 51 placed below the left edge 31*b* of the inlet port 31, and the exhaust gases produced from the gas burners 52 placed below the right edge 31*a* of the inlet port 31 are evenly drawn to the exhaust passage 13 through the inlet port 31. The exhaust gases entering the exhaust passage 13 are discharged to the outside after passing through the exhaust fan 14.

Figure 3:
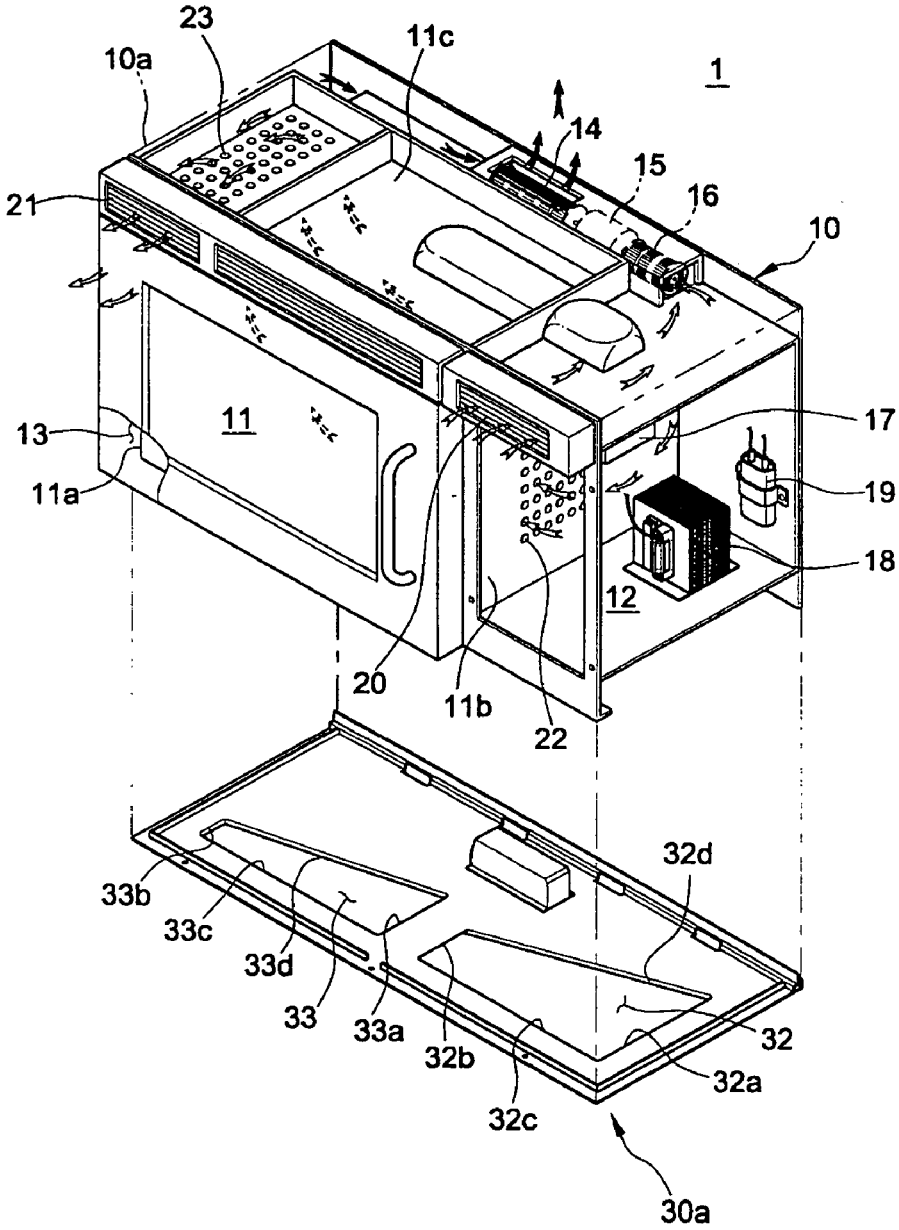
FIG. 3 is an exploded front perspective view to show a wall mounted-type microwave oven having a hood according to a second embodiment of the present invention.
Figure 4:
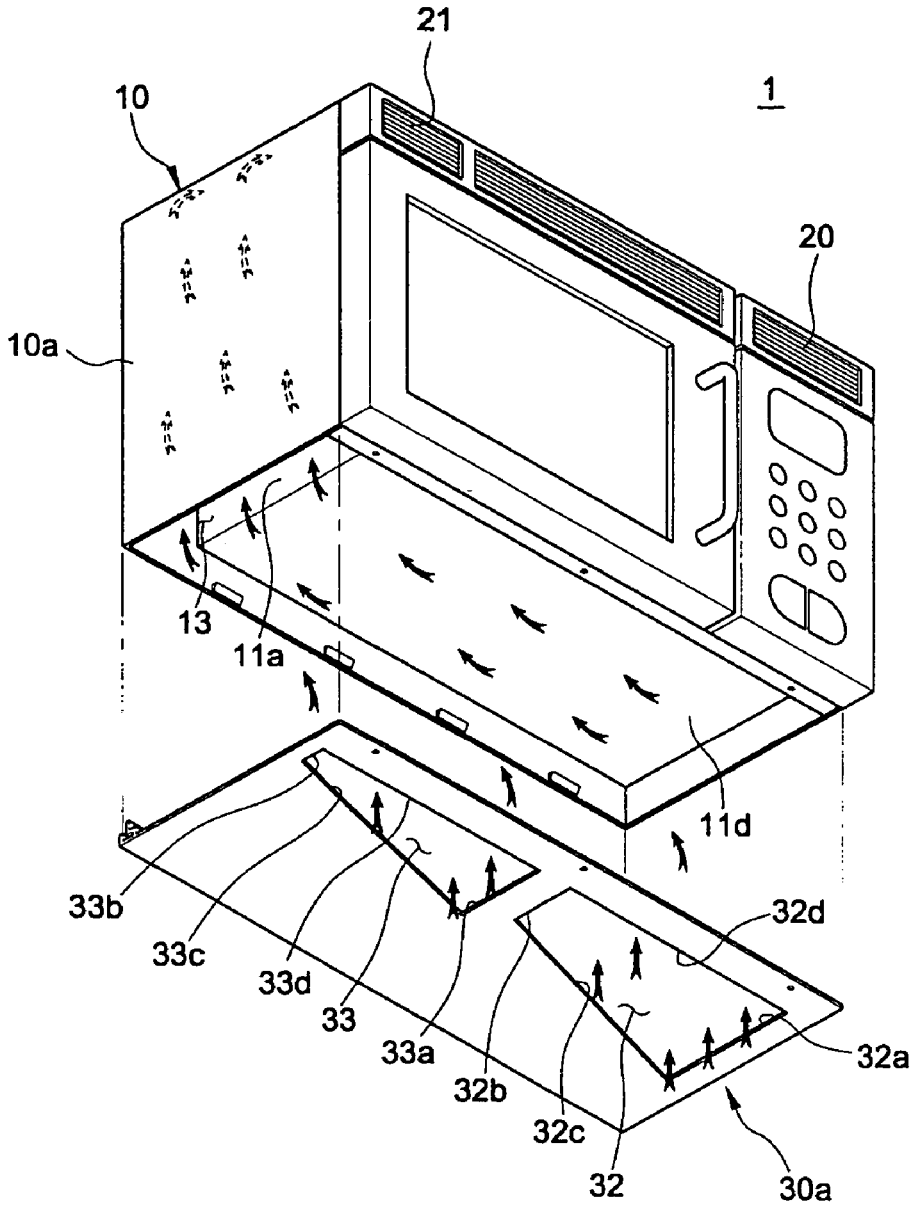
FIG. 4 is an exploded bottom perspective view of the wall mounted-type microwave oven of FIG. 3 to show a flow of exhaust gases passing through the hood.

FIGS. 3 and 4 respectively show an exploded front perspective view and an exploded bottom perspective view of a wall mounted-type microwave oven having a hood, according to a second embodiment of the present invention.

As shown in FIGS. 3 and 4, the wall mounted-type microwave oven 1 according to the second embodiment includes the cabinet 10 with the hood 30*a* mounted to the bottom portion of the cabinet 10. First and second inlet ports 32 and 33, which have the same shape as the inlet port 31 of the wall mounted-type microwave oven 1 of the first embodiment, are provided on right and left sides of the hood 30*a*, respectively. Accordingly, the general construction of the wall mounted-type microwave oven 1 according to the second embodiment remains the same as the wall mounted-type microwave oven 1 according to the first embodiment, with the exception of a plurality of inlet ports 32 and 33 provided in the hood 30*a*.

According to an aspect of the present invention, the first and second inlet ports 32 and 33 each having a trapezoidal shape, are placed on the right and left sides of the hood 30*a* spaced from each other by a predetermined distance.

The first inlet port 32, provided on the right side of the hood 30*a*, is formed so that a right edge 32*a* of the first inlet port 32 is longer than a left edge 32*b* of the first inlet port 32. Thereby, a length from a front edge 32*c* to a rear edge 32*d* of the first inlet port 32, that is, a width of the first inlet port 32 is gradually decreased in a direction from the right edge 32*a* to the left edge 32*b* of the first inlet port 32. Thus, a portion around the left edge 32*b* of the first inlet port 32 near the exhaust passage 13 has a smaller area than a portion around the right edge 32*a* of the first inlet port 32, which is far from the exhaust passage 13.

Similarly, the second inlet port 33 provided on the left side of the hood 30*a* is formed so that a right edge 33*a* of the second inlet port 33 is longer than a left edge 33*b* of the second inlet port 33. Thereby, a length from a front edge 33*c* to a rear edge 33*d* of the second inlet port 33, that is, a width of the second inlet port 33 is gradually decreased in a direction from the right edge 33*a* to the left edge 33*b* of the second inlet port 33. Thus, a portion around the left edge 33*b* of the second inlet port 33 near to the exhaust passage 13 has a smaller area than a portion around the right edge 33*a* of the second inlet port 33, which is far from the exhaust passage 13.

The hood 30*a* of the second embodiment, which is constructed as described above, has the same operational effect as the hood 30 of the first embodiment. Thus, according to the wall mounted-type microwave oven of the present invention, the exhaust gases produced from the gas burners 51 placed below the left side of the hood 30*a*, are smoothly drawn into the second inlet port 33, while the exhaust gases produced from the gas burners 52 placed below the right side of the hood 30*a*, are smoothly drawn into the first inlet port 32.

According to the second embodiment, two inlet ports 32 and 33 are provided on predetermined portions of the hood 30*a*. However, according to an aspect of the present invention, three or more inlet ports may be provided to the hood 30*a*.

Figure 5:
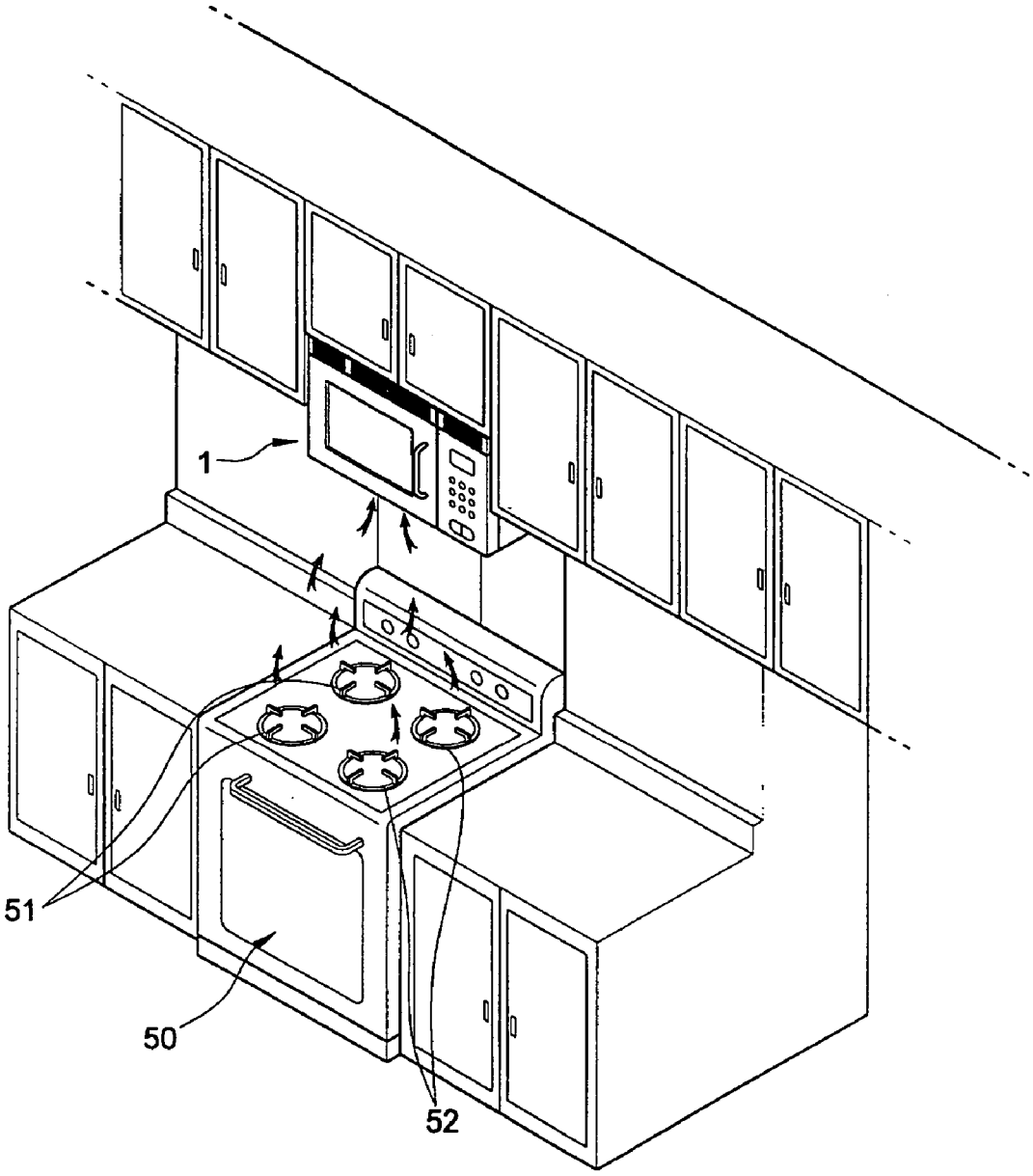
FIG. 5 is a perspective view of the wall mounted-type microwave oven according to an aspect of the present invention, which is placed above a cooking apparatus having a plurality of gas burners.

FIG. 5 is a perspective view of the wall mounted-type microwave oven according to the present invention, which is placed above the complex cooking apparatus having the plurality of gas burners.

As shown in FIG. 5, the wall mounted-type microwave oven 1 is mounted to a wall of a kitchen, and the complex cooking apparatus 50 which has the plurality of gas burners 51 and 52 on an upper portion of the complex cooking apparatus 50, is placed below the wall mounted-type microwave oven 1.

In this case, the gas burners 51 provided on a left side of the upper portion of the cooking apparatus 50 are relatively near to the exhaust passage 13 which is interiorly provided on the left side of the cabinet 10, while the gas burners 52 provided on a right side of the upper portion of the cooking apparatus 50 are relatively far from the exhaust passage 13. However, according to an aspect of the present invention, the inlet ports 31, 32, 33 have an area which is decreased in a direction towards the exhaust passage 13, thus evenly drawing the exhaust gases produced from the gas burners 51 and 52 provided on the left and right sides of the cooking apparatus 50, and discharging the exhaust gases to the outside.

As is apparent from the above description, the present invention provides a wall mounted-type microwave oven, which is constructed so that a width of an inlet port provided to a predetermined portion of a hood is decreased at a predetermined ratio in a direction towards an exhaust passage provided on a predetermined portion of a cabinet, thus allowing exhaust gases and food odors produced from a gas burner near the exhaust passage and a gas burner far from the exhaust passage to be smoothly drawn into the hood and discharged to an outside.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A wall mounted-type microwave oven, comprising:

a cabinet having an exhaust passage; and a hood mounted to a bottom portion of the cabinet and having a first side shorter than a second side and at least one inlet port to communicate with the exhaust passage, where the inlet port is formed so that a width of an end portion of the inlet port near the exhaust passage and parallel to the first side of the hood is less than a width of an end portion of the inlet port far from the exhaust passage, and the end portion of the inlet port near the exhaust passage is provided substantially below the exhaust passage.

2. The wall mounted-type microwave oven according to claim 1, wherein the inlet port is shaped so that a width thereof is decreased at a predetermined ratio in a direction towards the exhaust passage.

3. The wall mounted-type microwave oven according to claim 1, wherein the inlet port comprises:

a plurality of inlet ports which are horizontally arranged on the hood.

4. The wall mounted-type microwave oven according to claim 3, wherein the plurality of inlet ports are spaced from each other by a predetermined distance.

5. The wall mounted-type microwave oven according to claim 1, wherein the inlet port has a trapezoidal shape.

6. A wall mounted-type microwave oven, comprising:

a cabinet having an exhaust passage;

an exhaust fan provided at a predetermined position of the exhaust passage;

a hood mounted to a bottom of the cabinet, the hood having a first side shorter than a second side; and an inlet port horizontally provided to a predetermined portion of the hood to communicate with the exhaust passage, and the inlet port being formed so that an area of a portion of the inlet port on which a weaker suction force of the exhaust fan acts is larger than an area of a portion of the inlet port on which a stronger suction force of the exhaust fan acts and the area of the portion of the inlet port having the stronger suction force is provided substantially below the exhaust passage and parallel to the first side of the hood.

7. The wall mounted-type microwave oven according to claim 6, wherein the inlet port is shaped so that a width thereof is decreased at a predetermined ratio in a direction towards the exhaust passage.

8. The wall mounted-type microwave oven according to claim 6, wherein the inlet port comprises:

a plurality of inlet ports which are horizontally arranged on the hood.

9. The wall mounted-type microwave oven according to claim 6, wherein the inlet port has a trapezoidal shape.

10. The wall mounted-type microwave oven according to claim 1, wherein the at least one inlet port is formed spaced from left and right edges of the hood by a predetermined distance.

11. A wall mounted-type microwave oven having a cabinet, comprising:

an exhaust passage provided to the cabinet;

a hood mounted to a bottom portion of the cabinet, the hood having a first side shorter than a second side; and an inlet port provided to the hood, wherein an edge of the inlet port at which a suction force is greater is shorter than another edge of the inlet port at which the suction force is weaker and the edge of the inlet port at which the suction force is greater is provided substantially below the exhaust passage and parallel to the first side of the hood.

12. The wall mounted-type microwave oven according to claim 11 wherein the shorter edge of the inlet port is near the exhaust passage.

13. The wall mounted-type microwave oven according to claim 12, wherein a portion of an area of the shorter edge of the inlet port is smaller than a portion of an area of the other edge of the inlet port at which the suction force is weaker.

14. A wall mounted-type microwave oven having a cabinet, comprising:

an exhaust passage provided to the microwave oven;

a hood mounted to a bottom portion of the cabinet, said hood having a first side shorter than a second side; and first and second inlet ports provided to the hood, wherein edges of the first and second inlet ports closer to the exhaust passage have an area smaller than edges of the first and second inlet port farther from the exhaust passage and at least one of the edges of the first and second inlet ports closer to the exhaust passage is provided substantially below the exhaust passage, and the edges of the first and second inlet ports having the smaller area are parallel with respect to each other and parallel to the first side of the hood.

15. The wall mounted-type microwave oven according to claim 14, wherein the first and second inlet ports are shaped so that a width thereof is decreased at a predetermined ratio in a direction towards the exhaust passage.

16. The wall mounted-type microwave oven according to claim 15, wherein the first and second inlet ports are formed spaced from left and right edges of the hood by predetermined distances.

17. A wall mounted-type microwave oven having a cabinet, comprising:

a hood mounted to a bottom portion of the cabinet, the cabinet having an exhaust passage and the hood having a first side shorter than a second side; and an inlet port horizontally provided to the hood, where a first edge of the inlet port has a width greater than a second edge of the inlet port provided directly below the exhaust passage and is parallel to the first side of the hood.

18. A wall mounted-type microwave, comprising:

a cabinet having an exhaust passage, the cabinet having a first side shorter than a second side; and an inlet port extending across a substantial bottom portion of the cabinet such that a width of an end portion of the inlet port provided near the exhaust passage is parallel to the first side of the hood and is less than a width of an end portion of the inlet port far from the exhaust passage.

* * * * *